United States Patent [19]

King et al.

[11] Patent Number: 4,554,419

[45] Date of Patent: Nov. 19, 1985

[54] TOUCH SELECTION PANEL FOR A VENDING MACHINE

[75] Inventors: Eddie W. King, Marietta; Herman K. Duke, Atlanta; Don S. Summerville, Decatur, all of Ga.

[73] Assignee: The Coca-Cola Company, Atlanta, Ga.

[21] Appl. No.: 557,320

[22] Filed: Dec. 2, 1983

[51] Int. Cl.[4] ..... H01H 13/70

[52] U.S. Cl. ..... 200/5 A; 200/317

[58] Field of Search ..... 200/5 A, 159 B, 308, 200/309, 311, 314, 317; 40/463, 464, 465, 584

[56] References Cited

U.S. PATENT DOCUMENTS

| | | | |
|---|---|---|---|
| 3,591,749 | 7/1971 | Comstock | 200/308 |
| 3,757,322 | 9/1973 | Barken et al. | 340/365 C |
| 3,777,222 | 12/1973 | Harris | 340/365 S |
| 4,056,699 | 11/1977 | Jordan | 200/5 A |
| 4,121,204 | 10/1978 | Welch et al. | 340/337 |
| 4,171,584 | 10/1979 | Kaiser | 40/490 |
| 4,218,603 | 8/1980 | Satoh | 200/312 |
| 4,250,495 | 2/1981 | Beckerman et al. | 340/365 C |
| 4,257,179 | 3/1981 | Oka et al. | 40/378 |
| 4,377,049 | 3/1983 | Simon et al. | 40/465 |
| 4,380,130 | 4/1983 | Bachmann | 40/584 |
| 4,414,768 | 11/1983 | Bachmann et al. | 40/584 |
| 4,454,670 | 6/1984 | Bachmann et al. | 40/584 |

*Primary Examiner*—J. R. Scott

*Attorney, Agent, or Firm*—Birch, Stewart, Kolasch & Birch

[57] ABSTRACT

A touch-sensitive selection panel structure for a vending machine including a pressure-sensitive membrane-type switch contained between first and second polycarbonate panels comprising the display panel of the vending machine. The touch-sensitive switch configuration is totally transparent to visible light. A product selector window array on the first polycarbonate panel is back-illuminated from within the vending machine with images of the vendable products available, for display in the selector windows on the front face of the vending machine display panel. The images are provided on the back face of the second polycarbonate panel within the vending machine and illuminated from behind in order to project the names and product logos through the membrane switch, and the first polycarbonate panel for viewing by a potential customer. The membrane switch contacts are easily actuatable by merely pressing on a flexible product window area defined in the first polycarbonate sheet, which causes selected membrane switch contacts to close and initiate the vend of a corresponding product. In an alternative embodiment, the membrane switch is replaced by discrete touch-sensitive switches disposed in portions of each of the window areas.

14 Claims, 11 Drawing Figures

TOUCH SELECTION PANEL FOR A VENDING MACHINE

FIELD OF THE INVENTION

The present invention relates to display panels for vending machines, and more particularly to improved configurations for the same, in combination with suitable control panel structures within said display panel. More specifically, the present invention relates to a display panel including a control panel portion wherein product selection is initiated by depressing touch-sensitive switch areas on the control panel.

BACKGROUND OF THE INVENTION

In the vending of beverages from vending machines, particularly those beverages packaged in cans, bottles, or generally similar symmetrical containers, the display panels of the vending machines involved should perform certain point-of-purchase functions. For example, the nature of the products vended should be instantly apparent to a potential customer. The identify of the source or origin (manufacturer) of the products being vended should be either directly provided or provided by means such as logos or other symbolic means suggestive thereof.

Further, if there is a primary product for which the vending machine has more capacity or for which greater sales volume is desired, the vending machine should be capable of encouraging the selection of this product over the other products (secondary products) present in the machine.

Vending machines of this general type are disclosed in U.S. Pat. Nos. 4,380,130 and 4,414,768, assigned to the same assignee as the present invention.

The display panel face of such a vending machine should also be capable of containing other utilitarian areas in optimum locations for providing such things as point-of-sale advertising, coupon dispensers, video games, and the like, such as described in prior copending application Ser. No. 327,461, filed Dec. 4, 1981, now U.S. Pat. No. 4,454,670 and assigned to the same assignee as the present invention.

In the vending machines described in each of the aforementioned U.S. Patents and application, the product selector switches comprise spring-biased actuating buttons which protrude from the face of the vending machine and include many complex moving parts and interconnections to the associated vending machine control panel structure, and the associated electrical circuitry which initiates the vend of a product. Because of this large number of moving parts and interconnections, these selector switch arrays are relatively expensive and prone to failure under heavy use.

Accordingly, it is desirable to eliminate the number of mechanical parts known heretofore in selector switch arrays, and to reduce the number of electrical and mechanical connections of these selector switch arrays within the vending machine.

SUMMARY OF THE INVENTION

Accordingly, it is a primary object of the present invention to provide an improved product selector switch array for a vending machine, having a minimum number of moving parts and electrical connections, and a structure of high reliability.

It is another object of the present invention to provide such a product selector switch array which is not easily damaged by vandals, and which is easily replaceable if the need arises.

Another object of the present invention is to provide a new and novel display panel for vending machines, including the aforementioned switch structure in combination with configurations formed by display fields on that panel which both directly and symbolically identify the manufacturer (source or origin) of the products being vended.

It is a further object of the present invention to provide a utility module area within the display panel of a vending machine, making the module suitable for use for point-of-sale advertising, voice-synthesized or recorded messages, electronic or video games, coupon dispensers, bill validators, pricing information, or any other suitable equipment compatible with the coin-operated vending of products.

The objects of the present invention are fulfilled by providing a touch-sensitive switch structure of the membrane type sandwiched between first and second polycarbonate panels comprising the display panel of the vending machine. The touch-sensitive switch configuration is of the membrane type, and is totally transparent to visible light. Accordingly, the product selector switch array may be back-illuminated from within the vending machine with images of the vendable products available, for display on the front face of the vending machine display panel. That is, the names of the vendable products and/or logo thereof may be provided on the back face of the second polycarbonate panel within the vending machine and illuminated from behind in order to project the names and product logos through the membrane switch, and the first polycarbonate panel for viewing by a potential customer.

The membrane switches are easily actuatable by merely pressing on a flexible product window area defined in the first polycarbonate sheet, which causes the membrane switch to close in that area and initiate the vend of the corresponding product.

The first polycarbonate sheet may be coextensive with the second polycarbonate sheet, and adhesively secured thereto. However, in this embodiment of the present invention, adhesive is left off of the area of the first polycarbonate sheet, which will be opposite to the membrane switch, so that the surrounding adhesive defines a pocket in which the membrane switch may be supported.

In the alternative, the first polycarbonate sheet may only be as large in area, or coextensive with, the rectangular area of the membrane switch array. In this embodiment, the first polycarbonate sheet could be placed in a rectangular frame, and bolted to the second polycarbonate sheet, sandwiching the membrane switch therebetween in a pocket configuration defined by the rectangular frame.

In either of the aforementioned embodiments, the membrane switch is easily inserted into either form of pocket structure through an escutcheon plate opening, passing through either or both panels just above the top opening to the pocket. Therefore, maintenance and/or replacement of the switch array may be easily performed.

In a further alternative embodiment, the continuous membrane switch array described above is replaced by discrete, touch-sensitive bars protruding from each of a plurality of product selector display areas.

In each of the above-described embodiments, the display panel configurations, including touch-sensitive product selector switch areas, cover the upper three quarters of the display face of the vending machine. However, in an alternative embodiment, the polycarbonate panel and display fields thereon may extend over the entire obverse face of the vending machine, providing a substantially flush front face.

The present invention also provides for a novel coin acceptor escutcheon plate, including a conventional coin slot, a coin ejector, and the addition of cut-outs for receiving bill validators and acceptors or coupon dispenser outlets, as well as control button panels for video games to be disposed thereabove.

The display panel configuration of the present invention also provides for transparent window areas in the display panel for point-of-sale advertising, pricing information, or screens for video games. All of these windows are disposed just above the novel escutcheon plate of the present invention.

The objects of the present invention will become more fully apparent with reference to the following specification and drawings, which relate to several preferred embodiments of the present invention.

BRIEF DESCRIPTION OF THE DRAWINGS

The objects of the present invention and the attendant advantages thereof will become more readily apparent by reference to the accompanying drawings wherein like reference numerals refer to like parts and wherein.

DETAILED DESCRIPTION OF PREFERRED EMBODIMENTS

Figure 1:
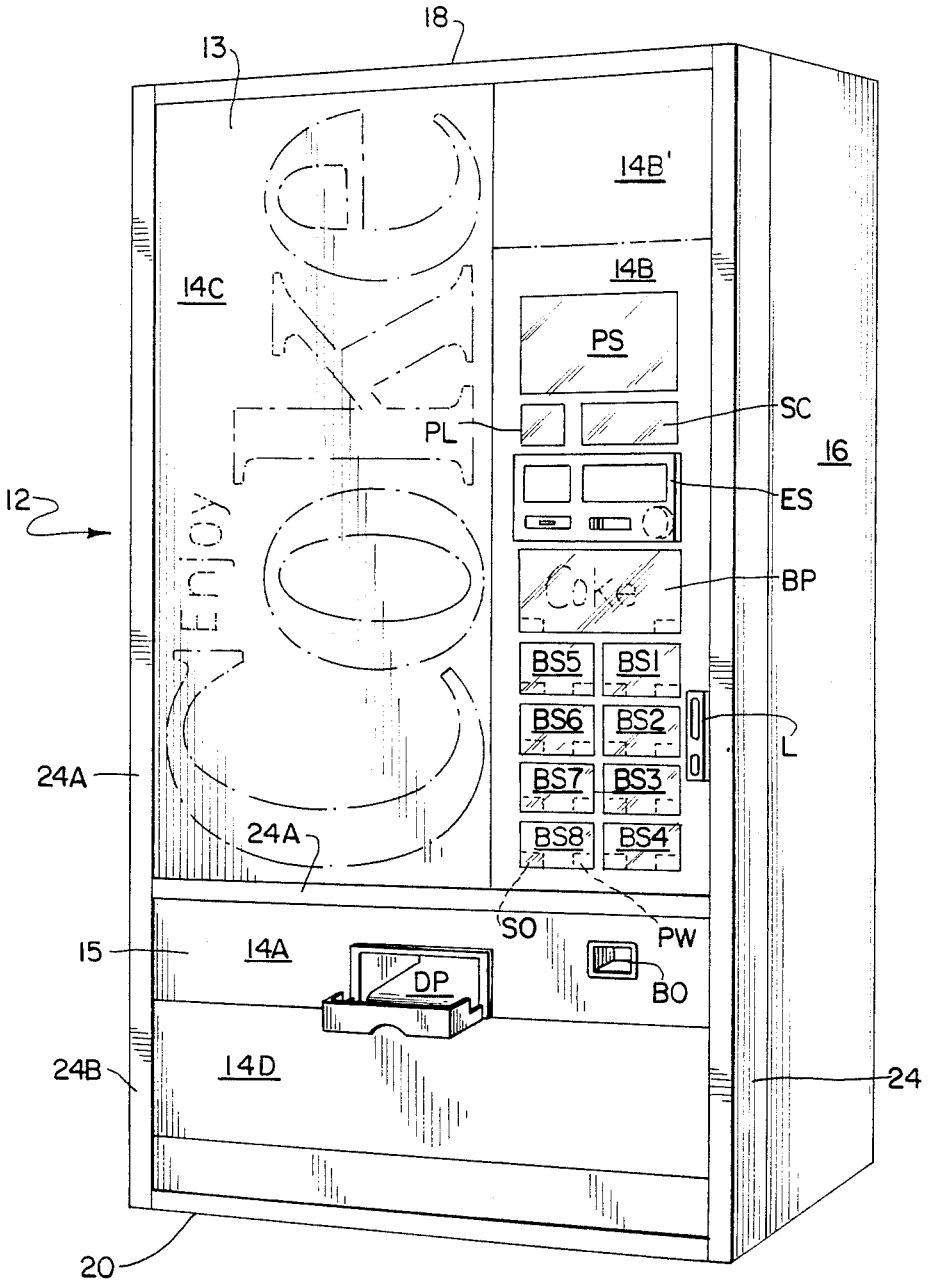
FIG. 1 is a front perspective view of a first embodiment of a vending machine in accordance with the present invention.

Referring to a first embodiment of the present invention illustrated in FIG. 1, a vending machine 12 is illustrated as being a three-dimensional, rectangular structure, having vertical sides 16 joining horizontal top and bottom sides 18 and 20, respectively. The structure of the vending machine 12 is completed by a flat, planar rear surface and a front panel comprising a door 24 including display panels 13 and 15 as the obverse face thereof.

The door 24 may include a vandal guard strip (not shown) along the free-swinging, vertical edge thereof, and is provided with hinges (not shown) at the top and bottom of the door on the opposite vertical side thereof (the left-hand side as viewed in FIG. 1), to permit access to the interior of the vending machine 12 upon the release of a lock L. The details of the hinge and vandal guard structure form no part of the present invention, but are illustrated in detail in prior copending U.S. patent application, Ser. No. 327,461, filed Dec. 4, 1981 now U.S. Pat. No. 4,454,670.

Door 24 has a rectangular frame or molding 24A around the upper perimeter thereof, and extending across the face thereof about three-quarters of the way down from the top for supporting a polycarbonate panel structure 13, to be described further hereinafter with reference to FIG. 2. As will become more apparent hereinafter, the upper panel 13 includes three display fields, 14B, 14B′ and 14C in contrasting colors to collectively define selected configurations suggestive of the products to be vended.

Likewise, a lower display panel 15 is mounted in a rectangular frame or molding 24B on the face of door 24, and includes contrasting color display fields 14A and 14D. In one preferred embodiment of the present invention, display fields 14A, 14B, 14B′ are all the same color, preferably black; and display fields 14C and 14D are the same color, preferably red. In this embodiment, display field 14C, which is also backlighted and has "COKE" logo thereon, gives the appearance of an actual can of beverage.

In another embodiment, all display fields are colored as above, with the exception of display field 14B′, which in this embodiment is red instead of black. In this embodiment, display fields 14B′, 14C and 14D together approximate the shape of the letter "C". This letter "C" is, of course, an abbreviation for the primary product, "COKE".

As stated above, upper panel 13 is a polycarbonate panel, such as LEXAN, and the colors of the display fields 14B, 14B′ and 14C are silk screened thereon. However, transparent windows are left in display field 14B of panel 13 at the rectangular areas PS, PL, SC, BP, and BS1–BS8. That is, no black coloring is silk screened onto these areas. This is done for display purposes, to be more fully described hereinafter.

Figure 4:
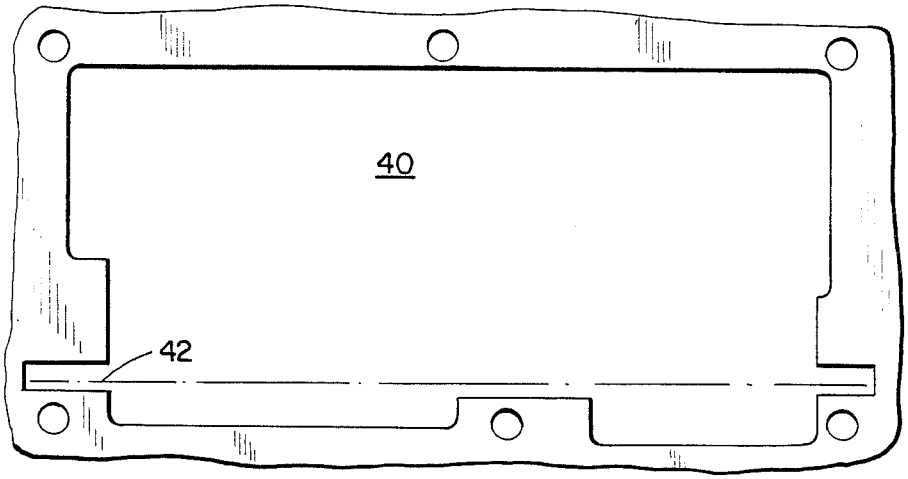
FIG. 4 is a plan view of the cut-out provided in the display panel structure of the present invention through which the membrane switch array structure of FIG. 3 may be readily inserted or removed.

In addition, upper panel 13 is provided with a cut-out underneath the escutcheon ES, having a shape illustrated in FIG. 4, to be described.

Panel 15 of door 24 and transversely disposed, opaque display field section 14A thereon in the embodiment illustrated in FIG. 1, include a discharge port DP and a bottle opener BO positioned side-by-side.

Opaque display field 14B defines a control panel, including a product selection portion. Display field 14B is basically rectangular in shape in the embodiment illustrated, and extends vertically from the upper, right-hand side of the transversely disposed first opaque field 14A. The vertical extent of the opaque field (control panel) 14B is variable. That is, it may include field 14B' in the same color, preferably black, or it may be red, making it the same color as display field 14C on panel 13. The effects of such a color selection are described hereinbefore. Display field 14B also includes a plurality of transparent window portions PS, PO, and SC. Window PS is provided for appropriate point-of-sale advertising, which may be in the form of adhesive stickers and backlighted to project images of the point-of-sale information into window PS. Window PL may be provided for displaying pricing information or special instructions in connection with the initiation of a vend. This information may also be provided by backlighting an appropriate sticker from within the vending machine, and projecting the information into window PL. Window SC may be provided for the screen of a video game, or a screen having images thereon which instruct a customer with respect to the operation of the vending machine in some way.

Figure 5:
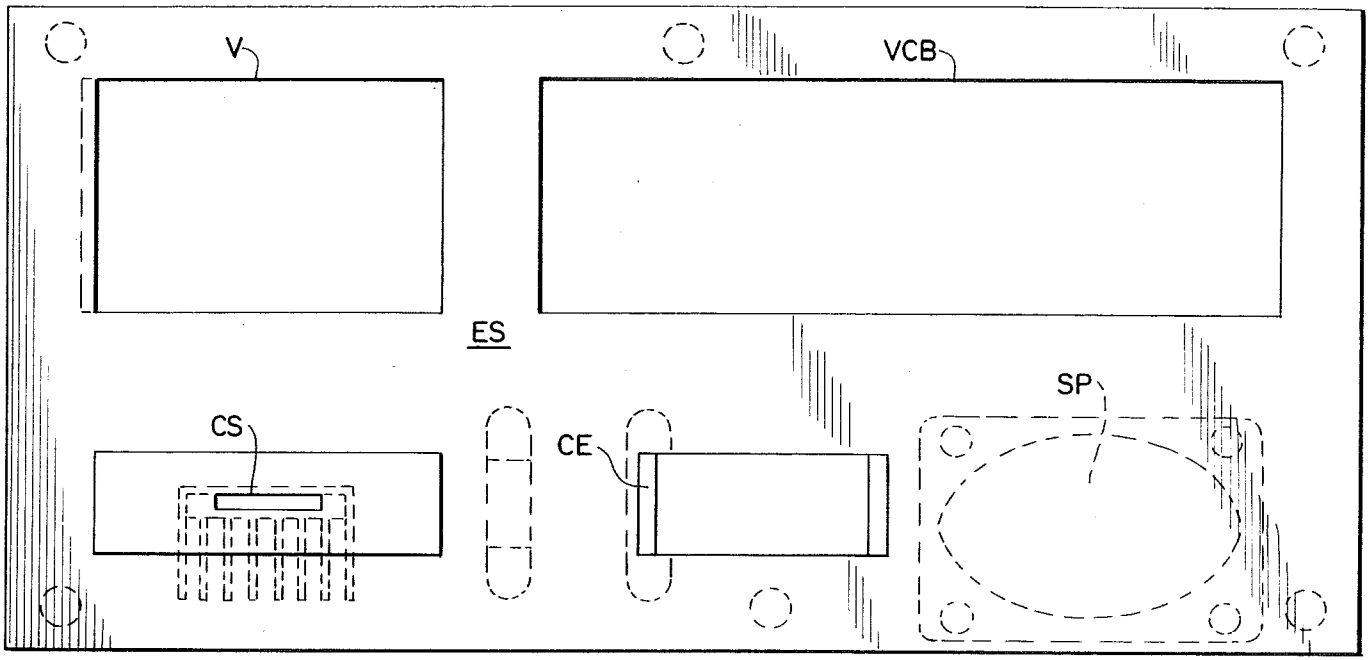
FIG. 5 is a plan view of the coin acceptor escutcheon plate, to be used with the vending machine embodiments of the present invention.

The novel escutcheon plate ES is provided in the vending machine of the present invention, as illustrated in FIG. 1, and as illustrated in more detail in FIG. 5. The escutcheon plate includes a conventional coin slot CS and a coin ejector CE. Just above the coin slot and ejector are a pair of cut-outs V and VCB. Cut-out V may be provided with a bill validator acceptor or a black blank if no acceptor is desired. Cut-out VCB may be provided with a video game control button array if window SC contains a screen of a video game, or in the alternative, may be provided with a coupon dispenser outlet if no video games are present in the machine.

A speaker SP may also be provided for use with a talking (synthesized-speech) module. Preferably, speaker SP is mounted to the back of escutcheon plate ES and not visible from the front thereof. Speaker SP may also be used to generate a confirmation signal, such as a "beep" in response to actuation of a touch-sensitive product selector window. The speaker could also generate other messages such as "thank you, your purchase is being processed".

Referring in further detail to FIG. 1, there is illustrated below coin acceptor escutcheon ES a plurality of product selector windows. An enlarged primary product touch selector window BP is provided just beneath the coin slot CS, and extends across two vertical columns of secondary product touch selector windows BS1 through BS8, the secondary product selector windows BS1 to BS4 constituting one column and the secondary product selector windows BS5 to BS8 constituting a second vertical column parallel to the first.

All the product selection windows BP, BS1 to BS8 display various logos or symbols identifying the products corresponding thereto within the vending machine 12. This is accomplished through backlighting, and the projection of such logos and images through these windows from within the vending machine. The details of this display technique will be described in connection with FIG. 2.

Optionally, each of the touch selector windows may be provided with the areas SO and PW (shown in dotted lines in FIG. 1) in the bottom corners thereof. The SO area may display dynamically changing messages such as "SOLD OUT" or "MAKE SELECTION", as signalled by the internal monitoring and control circuits of the machine. The PW area may display fixed or variable pricing information for a multiple price vending machine.

The structure of the display panel 13 in the vending machine of FIG. 1 will now be more fully described by reference to FIGS. 2 to 4. Panel 13 includes a front panel 13A of polycarbonate film, having a thickness range which may vary between 0.010 to 0.060 inches, depending on the pressure requirements to activate the membrane switch of FIG. 3, versus the maximum vandal resistance obtainable. Polycarbonate film 13A has an adhesive backing in all areas except those which register with the membrane switch MS of FIG. 3, directly behind the product selector display windows 46, illustrated in FIG. 1, as described hereinbefore and generally indicated on the front face of film 13A of FIG. 2. This adhesive backing is approximately 15 mils in thickness, and the membrane switch construction of FIG. 3 is approximately 13 mils in thickness. Accordingly, the area in which the adhesive AD is not applied forms a pocket 48 in which the membrane switch construction MS of FIG. 3 may be disposed.

The adhesive backing AD on the rear surface of film 13A is utilized to attach the film to a polycarbonate transparent backing sheet 13B of approximately 0.125 to 0.187 inches in thickness. As illustrated in FIG. 2, both film 13A and film 13B are provided with a cut-out over which escutcheon ES is bolted. The shape of this cut-out is illustrated in detail in FIG. 4, showing the cut-out generally indicated as 40 with a slot 42 at the bottom thereof. The slot 42 is provided so that the membrane switch construction MS of FIG. 3 may be readily inserted or removed through that slot into the pocket formed by the adhesive AD. This facilitates easy maintenance or replacement of a membrane switch construction MS, should it become damaged or need repair.

Referring more specifically to FIG. 3, the membrane switch construction S includes a front conductor plate 50, an intermediate spacer plate 52, including punched-out openings 52A and a back conductor plate 54. Back conductor plate 54 has discrete conductive areas thereon, typically tin oxide, corresponding to the locations of product selector windows BP and BS1 to BS8. On the other hand, front conductor plate 50 is made conductive across its entire surface, by a continuous coating of a conductive material such as tin oxide, and is connected to common or ground. It should be understood that the entire membrane switch array MS is substantially continuous and transparent across its entire surface, so that visible light images may be projected therethrough. To achieve transparency, plates 52 to 54 are typically transparent plastic film such as "MYLAR" with conductive material such as tin oxide coated thereon or dispersed therein. As illustrated in FIG. 3, membrane switch construction MS is provided with suitable holes at the top thereof for securing the same within the vending machine or the respective plates together, and a tail portion 56 is provided for connection to external circuit configurations which operate the product vending mechanism of the machine.

Figure 2:
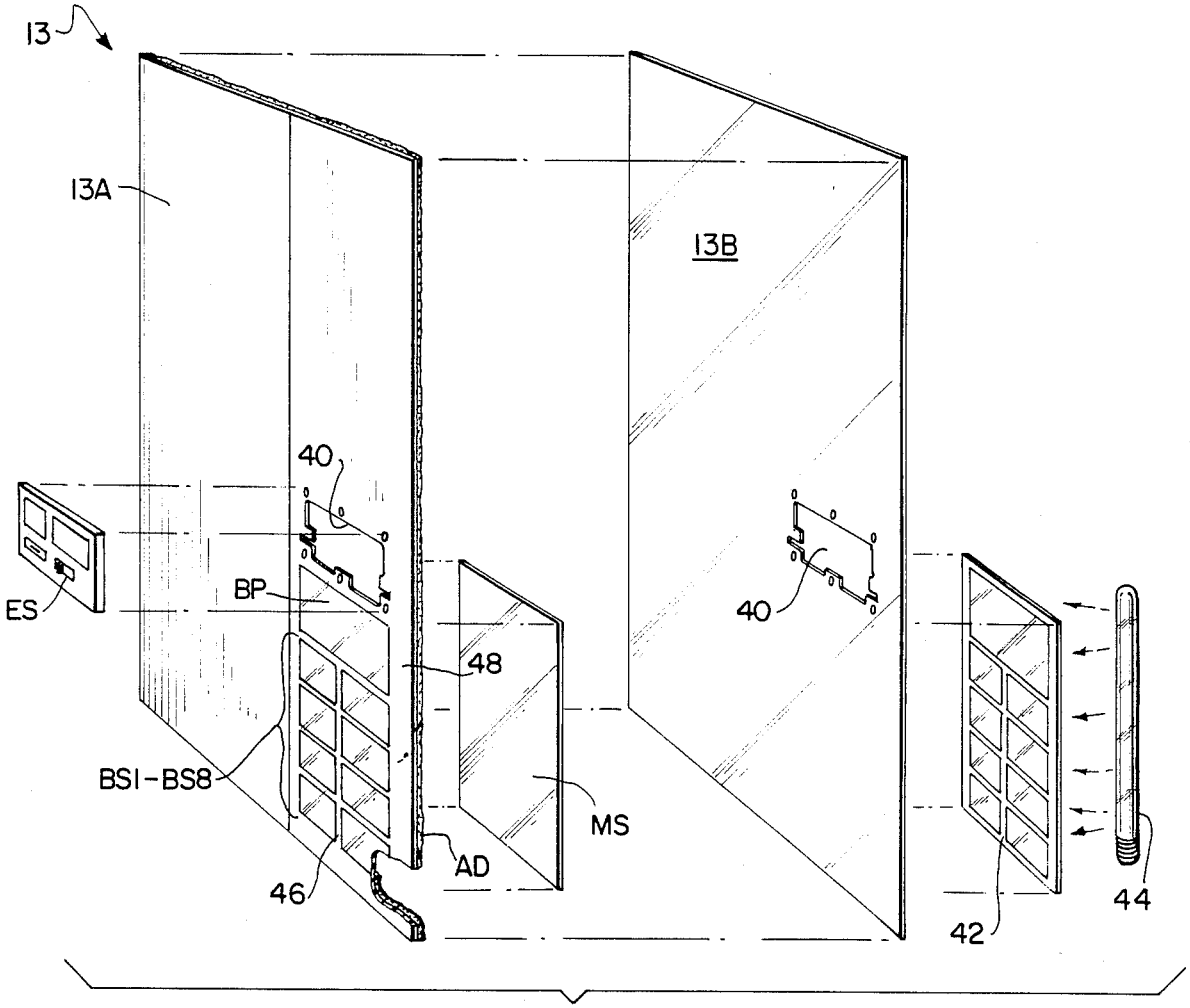
FIG. 2 is an exploded view, illustrating the structure of the display panel in the upper portion of the obverse face of the vending machine of FIG. 1 and how it supports the membrane switch selector structure, and the illumination system for projecting product information through display windows on the obverse face of the vending machine.
Figure 3:
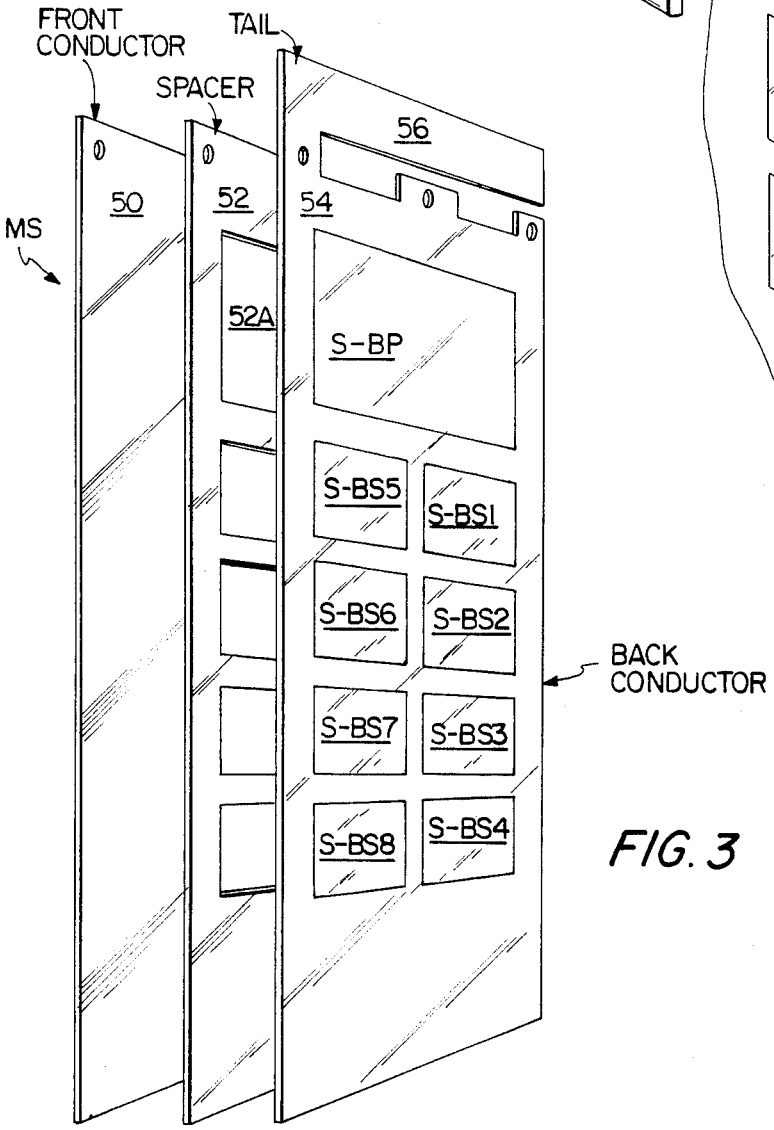
FIG. 3 is an exploded view, showing the multiple layers of the membrane switch structure of the present invention, suitable for use in the vending machine display panel structure of FIGS. 1 and 2 and in the structure of FIG. 6, to be described hereinafter.

Referring to FIG. 2, the manner in which product-identifying images are projected through the windows BP and BS1 to BS8 in the polycarbonate film 13A is illustrated. As described hereinbefore, polycarbonate film 13A is silk screened on the rear thereof with the proper colors in the respective display fields 14B, 14B' and 14C, described in connection with FIG. 1. The logo "COKE" in field 14C is also silk screened on the back of 13A. However, areas are left clear (transparent) in the regions of product display windows BP and BS1 to BS8. The membrane switch structure MS of FIG. 3 is disposed in the adhesive-bonded pocket 48 directly behind these product display windows, and is removably contained between polycarbonate film 13A and polycarbonate transparent backing sheet 13B. The product-identifying images or logo are provided in accordance with the present invention on a flavor strip 42 secured to the back of transparent polycarbonate sheet 13B. This flavor strip 42 is a color transparency, having appropriate indicia thereon, and may be secured to the back of sheet 13B by pressure-sensitive adhesive. Disposed just behind flavor strip 42 is a suitable, visible light source such as a pencil tube, fluorescent light 44. As can be seen from the diagrammatic illustration of FIG. 2, light from pencil tube, fluorescent light source 44 is projected through the color transparency of flavor strip 42, and in turn through sheet 13B, membrane switch MS, and the front product selector windows in film 13A. Accordingly, each of the product selector windows BP and BS1 to BS8 have projected thereon product-identifying images lined up with the associated contact areas of the membrane switch array MS. In the alternative, the logo "COKE" in enlarged window BP may be silk screened on back of that window on sheet 13A, rather than being part of the flavor strip transparency.

Therefore, product selection may be obtained merely by pressing on the polycarbonate film 13A in the selected product selector window region on the front face thereof associated with the product desired. Only a slight pressure is required against a window to cause the front conductor plate 50 of switch MS to flex and make contact through an associated aperture 52A in plate 52 aligned with the switch contact areas S-BP and S-BS1 to S-BS8.

Figure 6:
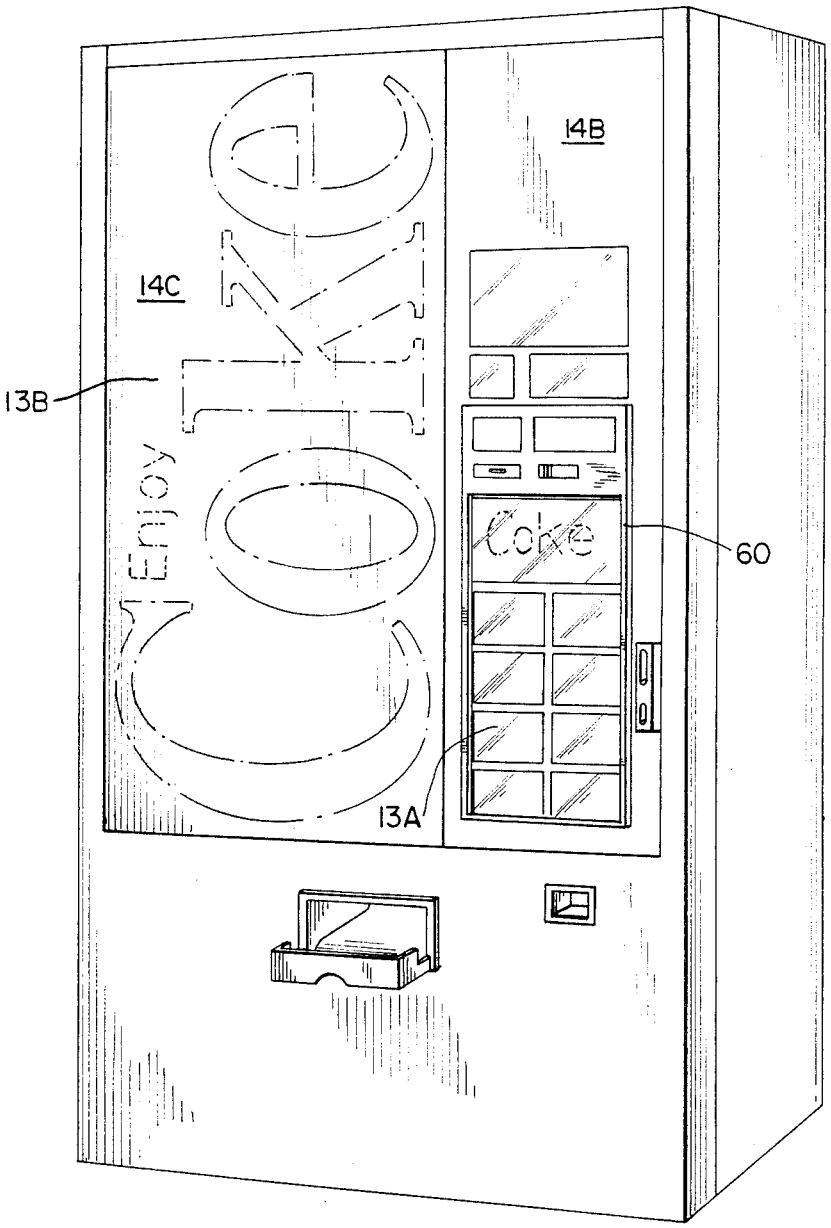
FIG. 6 is another embodiment of a vending machine in accordance with the present invention wherein the membrane switch array of FIG. 3 is supported in the display panel through an alternate means to that illustrated in FIG. 2.

In the embodiment described in connection with FIGS. 1 and 2, the display panel 13 includes a pair of polycarbonate sheets 13A and 13B, which are substantially coextensive in area across their abutting surfaces. Therefore, the thin, polycarbonate film 13A extends across approximately the upper three-quarters of the front face of the vending machine. As an alternative, the polycarbonate film 13A may have an area only as large as the area covering the product selector windows BP, BS1 to BS8, as illustrated in FIG. 6. In this embodiment, polycarbonate film 13A of a similar thickness to that in the embodiment of FIGS. 1 and 2, is mounted within a rectangular frame 60 which may be bolted to the polycarbonate backing sheet 13B. In this manner, the rectangular frame 60 forms the required pocket for receiving the membrane switch construction MS of FIG. 3. The membrane switch may be inserted or removed from this pocket through the escutcheon opening 40 and slot 42 thereof of FIG. 4, as described above with respect to the FIG. 1 embodiment.

In the embodiment of FIG. 6, polycarbonate sheet 13B would be silk screened on the back thereof with the appropriate colors, such as red and black, or logo "COKE" defining the display fields 14C and 14B, and the black color surrounding the transparent window areas defining the product selector windows would be silk screened onto the back of polycarbonate film 13A. The backlighting or illumination for displaying the product identification or flavors in the respective windows would operate in the same manner as illustrated in FIG. 2 by use of a flavor strip on the back of sheet 13B, and a suitable backlighting arrangement, such as provided by a pencil tube, fluorescent light 44.

Figure 8:
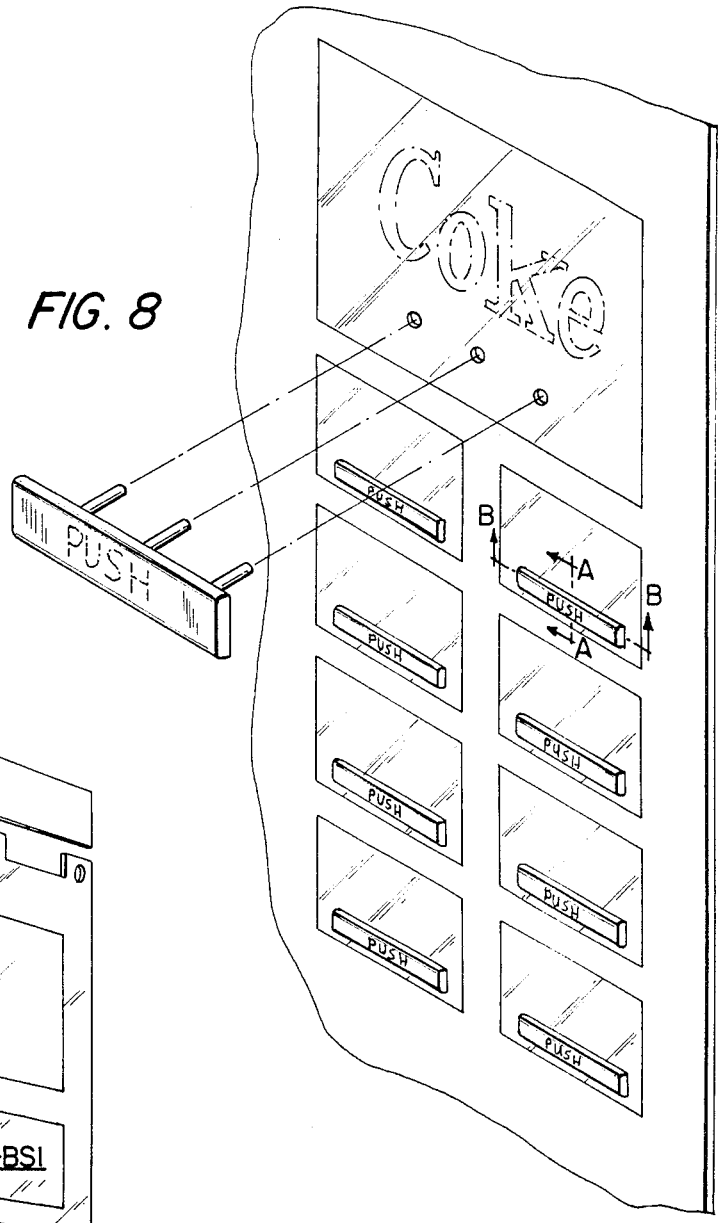
FIG. 8 is an enlarged view of the product selector portion of the display panel of FIG. 7, illustrating the protruding, discrete, touch-sensitive selector switches.
Figure 7:
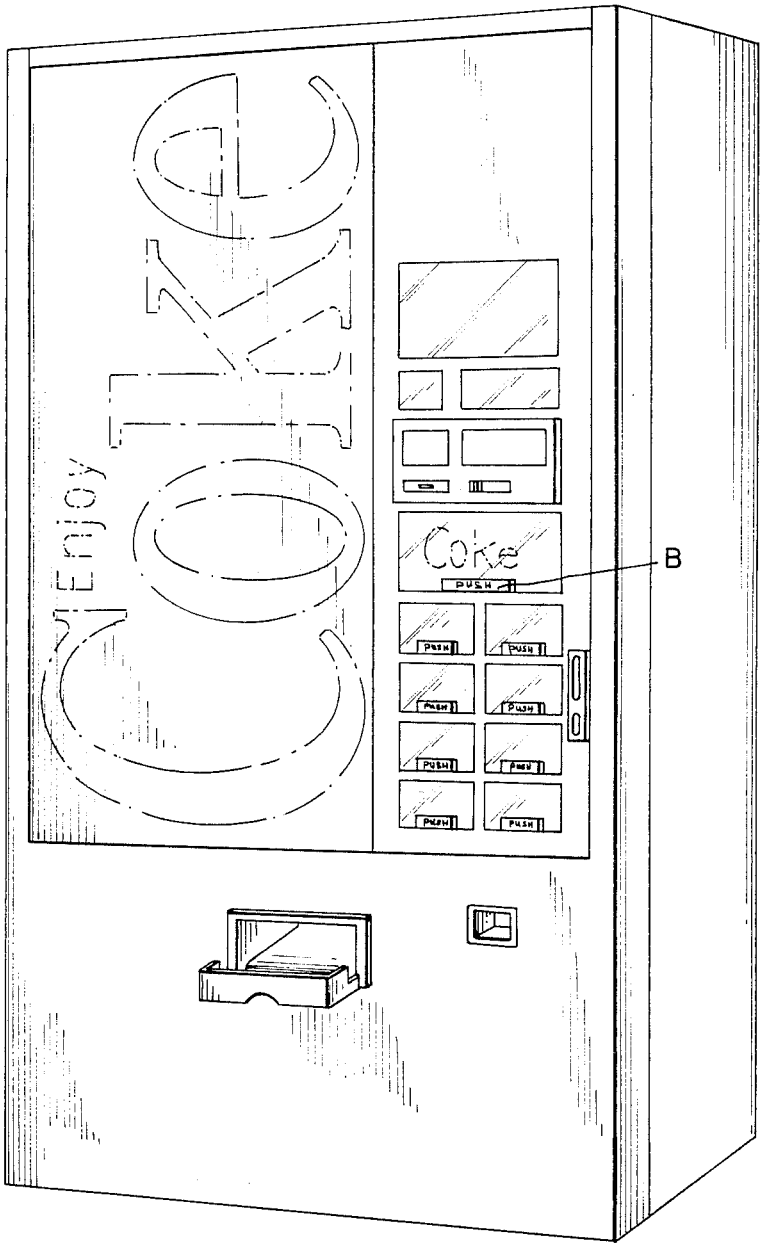
FIG. 7 illustrates yet another embodiment of the present invention wherein discrete, touch-sensitive product selector bars are utilized in conjunction with a polycarbonate display panel, instead of the continuous membrane selector switch array of FIG. 3.

FIGS. 7 to 9 illustrate still a further embodiment of the present invention wherein the membrane switch construction MS of FIG. 3 is replaced with discrete, touch-sensitive bars, as illustrated in FIGS. 8 and 9. These bars, labeled generally B, protrude from the product display window regions. They could have silk screened on the back thereof merely the indicia such as "PUSH", and indicia related to specific products to be selected would be projected from within the vending machine by backlighting techniques as described hereinbefore, into the appropriate display window regions.

Figure 9B:
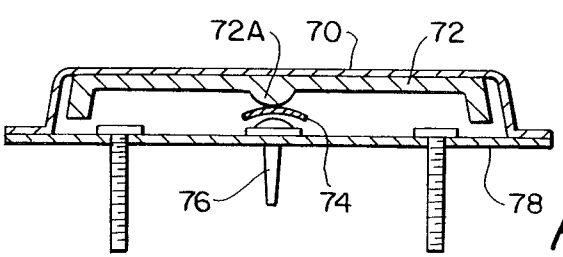
FIGS. 9A and 9B are cross-sectional views of the selector buttons per se illustrated in FIG. 8, taken along lines A—A and B—B thereof to illustrate the internal operation of these discrete touch-sensitive switches.
Figure 9A:
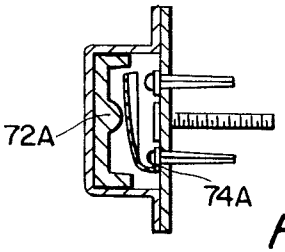

The touch-bar switch constructions could be of any suitable type provided by commercially-known, touch-sensitive switches; but one example or preferred embodiment is illustrated in cross-section in FIGS. 9A and 9B. FIGS. 9A and 9B are taken along lines A—A and B—B of a switch button B of FIG. 8. As illustrated, switches B include a flexible cover portion 70 which may be ultrasonically welded to a back base plate 78. On the interior of flexible cover 70 is a treadle 72 with a protrusion 72A thereon, aligned with a tactile contact 74. Tactile contact 74 is fixed at one end 74A about which it pivots into or out of contact with stationary electrical contact 76. Accordingly, when tactile contact 74 is in contact with stationary contact 76, the circuit is closed, initiating a vend of a selected product. Tactile contact 74 is spring-biased to return to its opened condition when pressure is no longer applied to flexible cover 70.

FIGS. 9A and 9B only show one possible touch-sensitive switch construction which may be utilized with the embodiments of FIGS. 7 and 8, there being many other commercially-available switch constructions which would be suitable for this purpose.

In a preferred embodiment, the legends such as "PUSH" would be silk screened in white on the back of the flexible cover 70, which is a clear plastic such as "LEXAN". In such an embodiment, treadle 72 would be black, providing the proper contrast between it and the white legend "PUSH".

Figure 10:
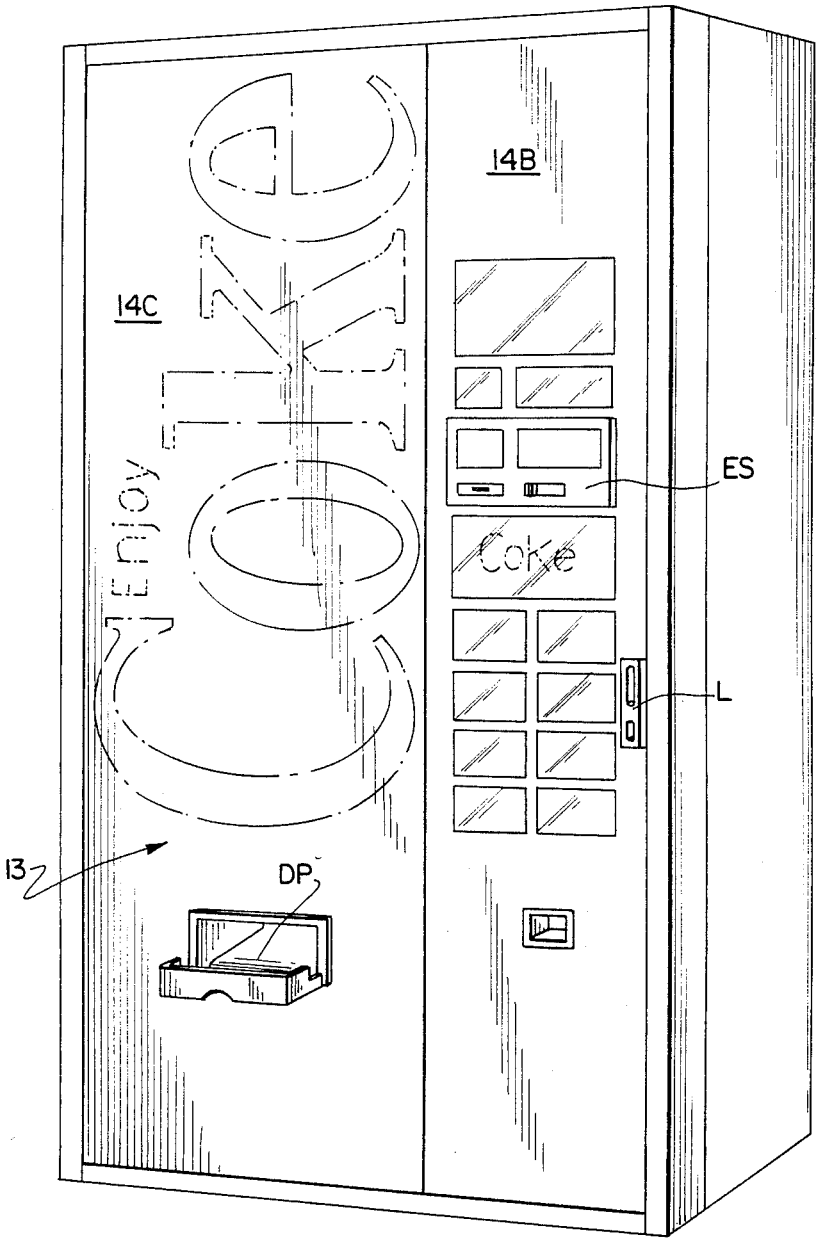
FIG. 10 illustrates still a further embodiment of the present invention wherein the display panel covers the entire front face of the vending machine, providing a substantially flush configuration.

Referring to FIG. 10, there is illustrated a further embodiment of the present invention wherein the display panel 13 covers the entire front face of the vending machine, providing a substantially flush construction or smooth, continuous surface. This embodiment could be fabricated by disposing a continuous membrane switch MS in an adhesive pocket, as described hereinbefore with reference to FIG. 2; by utilizing the discrete, protruding touch-sensitive bars as described in FIGS. 7 to 9; or by providing an entrapped membrane switch as described hereinbefore with reference to FIG. 6. In the embodiment of FIG. 10, the only substantial protrusions from the front face of the vending machine would be the discharge port DP, the escutcheon plate ES, and the lock mechanism L. In a preferred embodiment, the entire left-hand portion of panel 13 is red and the entire right-hand portion is black.

In the FIG. 10 embodiment, display fields 14A and 14B may be provided in a single, continuous LEXAN panel, or in the alternative field 14C may be a separate LEXAN panel and 14B a separate panel of sheet metal with product selector windows cut therein. The display field 14A is, of course, backlighted as in all other embodiments of the present invention described hereinbefore, to illuminate the "COKE" logo. The degree of illumination can be varied by the selected width of display field display field 14C. That is, 14C may be made much wider in proportion to display field 14B than illustrated, to increase the illumination of the primary product logo.

It should be understood that the vending machine display panel construction, including a touch-sensitive selector panel described hereinbefore, may be modified as would occur to one of ordinary skill in the art without departing from the spirit and scope of the present invention.

What is claimed is:

1. A touch-sensitive selection panel structure for a vending machine for initiating the vend of related products comprising:

(a) a first sheet member having transparent areas thereon defining touch-sensitive product selection windows, said first sheet member defining the obverse face of said selection panel;

(b) pressure-sensitive switch means disposed directly behind and contiguous to said first sheet member, said switch means being responsive to pressure applied to said product selection windows to generate electrical signals for initiating the vend of related products, said switch means being transparent to visible light;

(c) a second sheet member secured to said first sheet member by an adhesive coating and having transparent areas thereon disposed behind and contiguous to said switch means; and (d) pocket means between said first and second sheet members for removably containing said pressure-sensitive switch means, said adhesive coating being relieved in area behind said product selection windows to define said pocket means.

2. The panel structure of claim 1, further comprising slot means in said first sheet member in communication with said pocket means, said pressure-sensitive switch means being insertable into and removable from said pocket means through said slot means.

3. The panel structure of claim 1, further comprising slot means in said first sheet member in communication with said pocket means, said pressure-sensitive switch means being insertable into and removable from said pocket means through said slot means.

4. The panel structure of claim 1, further comprising product-identifying indicia disposed behind said second sheet member in alignment with said windows, whereby said indicia may be viewed through said windows.

5. The panel structure of claim 4, wherein said product-identifying indicia comprises projection transparencies secured to the back of said second sheet member.

6. The panel structure of claim 5, wherein said transparencies are secured by adhesive.

7. The panel structure of claim 5 in combination with a visible light source disposed behind said second sheet member for projecting images of said indicia through said windows.

8. The panel structure of claim 1, wherein said pressure-sensitive switch means comprises first and second flexible films separated by an intermediate plate having openings therein aligned with said windows, one of said flexible films having discrete conductive areas thereon aligned with said openings, the other of said flexible films being conductive across the entire surface thereof, whereby pressure applied to said windows presses conductive areas of said first and second films together through said openings generating said electrical signals.

9. A method of making a display panel for a vending machine including a sign panel portion for displaying logo related to at least one product to be vended and a touch-sensitive selection portion for selectively initiating the vend of selected products, comprising the steps of:

(a) providing first and second transparent sheet members including said sign panel portion and said selection portion;

(b) applying coloring to both said portions of said first sheet member to define said logo in said sign panel portion and discrete transparent windows in said selection portion corresponding to the products to be vended;

(c) coating at least one of said sheet members with adhesive in substantially all areas except the area behind said transparent windows in the provision of a pocket for containing a touch-sensitive switch array; and (d) securing said first sheet member to said second sheet member with said adhesive.

10. The method of claim 9, comprising the further step of inserting a touch-sensitive switch array into said pocket.

11. The method of claim 10 wherein an opening is provided in said first sheet member just above said selection portion and said switch array is inserted into said pocket through said opening.

12. The method of claim 9, wherein said adhesive is applied to the back of said first sheet member.

13. The method of claim 10, wherein said adhesive is applied to the back of said first sheet member.

14. The method of claim 11, wherein said adhesive is applied to the back of said first sheet member.

* * * * *